US006413040B1

(12) United States Patent
Yu et al.

(10) Patent No.: US 6,413,040 B1
(45) Date of Patent: Jul. 2, 2002

(54) SUPPORT PEDESTALS FOR INTERCONNECTING A COVER AND NOZZLE BAND WALL IN A GAS TURBINE NOZZLE SEGMENT

(75) Inventors: Yufeng Phillip Yu; Gary Michael Itzel, both of Simpsonville; Waylon Willard Webbon, Greenville, all of SC (US); Radhakrishna Bagepalli; Steven Sebastian Burdgick, both of Schenectady, NY (US); Iain Robertson Kellock, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/593,276

(22) Filed: Jun. 13, 2000

(51) Int. Cl.[7] ..... F01D 5/14

(52) U.S. Cl. ..... 415/115; 415/116; 415/191; 415/208.2

(58) Field of Search ..... 415/115, 116, 415/191, 208.2

(56) References Cited

U.S. PATENT DOCUMENTS

| | | | | |
|---|---|---|---|---|
| 4,218,178 | A | 8/1980 | Irwin | 415/114 |
| 5,634,766 | A | 6/1997 | Cunha et al. | 415/115 |
| 5,954,475 | A | 9/1999 | Matsuura et al. | 415/115 |
| 6,019,572 | A | 2/2000 | Cunha | 415/114 |

OTHER PUBLICATIONS

"39$^{th}$ GE Turbine State–of–the–Art Technology Seminar", Tab 1,""F" Technology –the First Half–Million Operating Hours", H. E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA –An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines –Design and Operating Features", M. W. Horner, Aug. 1996.

"39th GE Turbine State–of–the–Art Technology Seminar", Tab 7, "Advance Gas Turbine Materials and Coatings", P. W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

"39th GE Turbine State–of–the–Art Technology Seminar", Tab 9, "GE Gas Turbine Combustion Flexibility", M. A. Davi, Aug. 1996.

(List continued on next page.)

*Primary Examiner*—Edward K. Look
*Assistant Examiner*—Ninh Nguyen
(74) *Attorney, Agent, or Firm*—Nixon & Vanderhye

(57) ABSTRACT

A gas turbine nozzle segment has outer and inner band portions. Each band portion includes a nozzle wall, a cover and an impingement plate between the cover and nozzle wall defining two cavities on opposite sides of the impingement plate. Cooling steam is supplied to one cavity for flow through the apertures of the impingement plate to cool the nozzle wall. Structural pedestals interconnect the cover and nozzle wall and pass through holes in the impingement plate to reduce localized stress otherwise resulting from a difference in pressure within the chamber of the nozzle segment and the hot gas path and the fixed turbine casing surrounding the nozzle stage. The pedestals may be cast or welded to the cover and nozzle wall.

18 Claims, 3 Drawing Sheets

OTHER PUBLICATIONS

"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, " J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program –Conceptual Design and Product Development", Annual Report, Sep. 1, 1994 –Aug. 31, 1995.
"Advanced Turbine Systems (ATS Program) Conceptual Design and Product Development", Final Technical Progress Report, vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993 –Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibits panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D. C., Publication Release.

"H Technology Commercialization", 1998 MarComm Activity Recommendation, Mar., 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency for GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21$^{st}$ Century –"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando , Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D. W. Esbeck, pp. 3–13, Oct., 1995.

"Proceedings of the Advanced Turbine Systems Annual Program Review Meeting", vol. I, "H Gas Turbine Combined Cycle", J. Corman, pp. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct., 1995.

"Proceedings of the Advanced Turbine Systems Annual Program Review Meeting", vol. I, "Allison Engine ATS Program Technical Review", D. Mukavetz, pp. 31–42, Oct., 1995.

"Proceedings of the Advanced Turbine Systems Annual Program Review Meeting", vol. I, "Advanced Turbine Systems Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct., 1995.

"Proceedings of the Advanced Turbine Systems Annual Program Review Meeting", vol. I, "Technical Review of Westinghouse's Advanced Turbine Systems Program", Diakunchak et al., pp. 75–86, Oct., 1995.

"Proceedings of the Advanced Turbine Systems Annual Program Review Meeting", vol. I, "Advanced Combustion Turbines and Cycles: An EPRI Perspective", Touchton et al., pp. 87–88, Oct., 1995.

"Proceedings of the Advanced Turbine Systems Annual Program Review Meeting", vol. I, "Advanced Turbine Systems Annual Program Review", William E. Koop, pp. 89–92, Oct., 1995.

"Proceedings of the Advanced Turbine Systems Annual Program Review Meeting", vol. I, "The AGTSR Consortium: An Update", Fant et al., pp. 93–102, Oct., 1995.

"Proceedings of the Advanced Turbine Systems Annual Program Review Meeting", vol. I, "Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.

"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al., pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerald McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.
"Proceedings of the Advanced Turbine Systems Annual Program Review Meeting", "Allison Advanced Simple Cycle Gas Turbine System", William D. Weisbrod, pp. 73–94, Nov., 1996.
"Proceedings of the Advanced Turbine Systems Annual Program Review Meeting", "The AGTSR Industry–University Consortium", Lawrence P. Golan, pp. 95–110, Nov., 1996.
"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov., 1996.
"Proceedings of the Advanced Turbine Systems Annual Program Review Meeting", "Methodologies for Active Mixing and Combustion Control", Uri Vandsburger, pp. 123–156, Nov., 1996.
"Proceedings of the Advanced Turbine Systems Annual Program Review Meeting", "Combustion Modeling in Advanced Gas Turbine Systems", Paul O. Hedman, pp. 157–180, Nov., 19967.
"Proceedings of the Advanced Turbine Systems Annual Program Review Meeting", "Manifold Methods of Methane Combustion", Stephen B. Pope, pp. 181–188, Nov., 1996.
"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.
"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.
"Proceedings of the Advanced Turbine Systems Annual Program Review Meeting", "Combustion Instability Studies Application to Land–Based Gas Turbine Combustors", Robert J. Santoro, pp. 233–252.
"Proceedings of the Advanced Turbine Systems Annual Program Review Meeting", Active Control of Combustion Instabilities in Low $NO_x$ Turbines, Ben T. Zinn, pp. 253–264, Nov., 1996.
"Proceedings of the Advanced Turbine Systems Annual Program Review Meeting", "Life Prediction of Advanced Materials for Gas Turbine Application," Sam Y. Zamrik, pp. 265–274, Nov., 1996.
"Proceedings of the Advanced Turbine Systems Annual Program Review Meeting", "Combustion Chemical Vapor Deposited Coatings for Thermal Barrier Coatings Systems", W. Brent Carter, pp. 275–290, Nov., 1996.
"Proceedings of the Advanced Turbine Systems Annual Program Review Meeting", "Compatibility of Gas Turbine Materials with Steam Cooling", Vimal Desai, pp. 291–314, Nov., 1996.
"Proceedings of the Advanced Turbine Systems Annual Program Review Meeting", "Bond Strength and Stress Measurements in Thermal Barrier Coatings", Maurice Gell, pp. 315–334, Nov., 1996.
"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.
"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.
"Proceedings of the Advanced Turbine Systems Annual Program Review Meeting", "Improved Modeling Techniques for Turbomachinery Flow Fields", B. Lakshiminarayana, pp. 371–392, Nov., 1996.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.
"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.
"Proceedings of the Advanced Turbine Systems Annual Program Review Meeting", "Experimental and Computational Studies of Film Cooling with Compound Angle Injection", R. Goldstein, pp. 447–460, Nov., 1996.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.
"Proceedings of the Advanced Turbine Systems Annual Program Review Meeting", "Steam as a Turbine Blade Coolant: External Side Heat Transfer", Abraham Engeda, pp. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.
"Proceedings of the Advanced Turbine Systems Annual Program Review Meeting", "Closed–Loop Mist/Steam Cooling for Advanced Turbine Systems", Ting Wang, pp. 499–512, Nov., 1996.
"Proceedings of the Advanced Turbine Systems Annual Program Review Meeting", "Heat Pipe Turbine Vane Cooling", Langston et al., pp. 513–534, Nov., 1996.
"Proceedings of the Advanced Turbine Systems Annual Program Review Meeting", "EPRI's Combustion Turbine Program: Status and Future Directions", Arthur Cohn, pp. 535,–552 Nov., 1996.
"Proceedings of the Advanced Turbine Systems Annual Program Review Meeting", "ATS Materials Support", Michael Karnitz, pp. 553–576, Nov., 1996.
"Proceedings of the Advanced Turbine Systems Annual Program Review Meeting", "Land Based Turbine Casting Initiative", Boyd A. Mueller, pp. 577–592, Nov., 1996.
"Proceedings of the Advanced Turbine Systems Annual Program Review Meeting", "Turbine Airfoil Manufacturing Technology", Charles S. Kortovich, pp. 593–622, Nov., 1996.
"Proceedings of the Advanced Turbine Systems Annual Program Review Meeting", "Hot Corrosion Testing of TBS's", Norman Bornstein, pp. 623–631, Nov., 1996.

"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine –High Efficiency, Low Cost of Electricity and Low Emissions", Roger Schonewald and Patrick Marolda, (no date available).
"Testing Program Results Validate GE's H Gas Turbine –High Efficiency, Low Cost of Electricity and Low Emissions", Slide Presentation –working draft, (no date available).
"The Next Step in H. . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1 –Dec. 31, 1996, Publication Date, Jun. 1, 1997, Report Nos: DOE/MC/31176—5628.
"Utility Advanced Turbine System (ATS) Technology Readiness Testing —Phase 3", Document #666274, Oct. 1, 1996–Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Document #486029, Oct. 1 –Dec. 31, 1995, Publication Date, May 1, 1997, Report Nos: DOE/MC/31176–5340.
"Utility Advanced Turbine System (ATS) Technology Readiness Testing and Pre–Commerical Demonstration –Phase 3", Document #486132, Apr. 1 –Jun. 30, 1976, Publication Date, Dec. 31, 1996 Numbers: DOE/MC/31176–5660.
"Utility Advanced Turbine System (ATS) Technology Readiness Testing and Pre–Commerical Demonstration—Phase 3", Document #587906, Jul. 1 –Sep. 30, 1995, Publication Date, Dec. 31, 1995, Report Numbers. DOE/MC/31176–5339.
"Utility Advanced Turbine System (ATS) Technology Readiness Testing and Pre–Commerical " Document #666277, Apr. 1 –Jun. 30, 1997, Publication Date, Dec. 31, 1997, Report Numbers: DOE/MC/31176–8.
"Utility Advanced Turbine System (ATS) Technology Readiness Testing and Pre–Commicalization Demonstration" Jan. 1 –Mar. 31, 1996, DOE/MC/31176—5338.
"Utility Advanced Turbine System (ATS) Technology Readiness Testing and Pre–Commicalization Demonstration" Jan. 1 –Mar. 31, 1996, DOE/MC/31176—5338.
"Ultilty Advanced Turbine System (ATS) Technology Readiness Testing.", Document #656823, Jan. 1 –Mar. 31, 1998, Publication Date, Aug. 1, 1998, Report Numbers: DOE/MC/31176–17.
"Utility Advanced Turbine System (ATS) Technology Readiness Testing and Pre–Commerical Demonstration", Annual Techincal Progress Report, Reporting Period: Jul. 1, 1995 –Sep. 30, 1996.
"Utlity Advanced Turbine System (ATS) Technology Readiness Testing", Phase 3R, Annual Technical Progress Report, Reporting Period: Oct. 1, 1997 –Sep. 30, 1998.
"Utility Advanced Turbine (ATS) Technology Readiness Testing", Document #75045, Oct. 1 –Dec. 30, 1998, Publication Date: May 1, 1999, Report Numbers: DE–FC21–95MC31176–20.
"Utility Advanced Turbine System (ATS) Technology Readiness Testing", Document #1348, Apr. 1 –Jun. 29, 1998, Publication Date Oct. 29, 1998 Report Numbers DE–FC21–95MC31176—18.
"Utlity Advanced Turbine System (ATS) Technology Readiness Testing and Pre–Commercial Demonstration", Quarterly Report, Jan. 1, –Mar. 31, 1997, Document #666275, Report Numbers: DOE/MC/31176–07.
"Proceedings of the 1997 Advanced Turbine Systems", Annual Program Review Meeting, Oct. 28–29, 1997.

40
44
38
36
12
34
32
18
30
14
17
16

SUPPORT PEDESTALS FOR INTERCONNECTING A COVER AND NOZZLE BAND WALL IN A GAS TURBINE NOZZLE SEGMENT

This invention was made with Government support under Contract No. DE-FC21-95MC31176 awarded by the Department of Energy. The Government has certain rights in this invention.

BACKGROUND OF THE INVENTION

The present invention relates to nozzle segments for gas turbines and particularly relates to steam cooled gas turbines having nozzle covers spaced from the nozzle wall defining the hot gas path and pedestals within the nozzle segments for interconnecting the nozzle wall and cover to reduce pressure-induced stress.

In current gas turbine designs, nozzle segments are typically arranged in an annular array about the rotary axis of the turbine. The array of segments forms outer and inner bands and a plurality of vanes extend between the bands. The bands and vanes define in part the hot gas path through the gas turbine. Each nozzle segment comprises an outer band portion and an inner band portion and one or more nozzle vanes extend between the outer and inner band portions. In current gas turbine designs, a cooling medium, for example, steam, is supplied to each of the nozzle segments. To accommodate the steam cooling, each band portion includes a nozzle wall in part defining the hot gas path through the turbine, a cover spaced radially from the nozzle wall defining a chamber therewith and an impingement plate disposed in the chamber. Each impingement plate defines with the cover a first cavity on one side thereof for receiving cooling steam from a cooling steam inlet and also defines along an opposite side thereof, and with the nozzle wall, a second cavity. Each impingement plate has a plurality of apertures for flowing the cooling steam from the first cavity into the second cavity for impingement cooling the associated nozzle wall. The cooling steam from the second cavity of the outer band portion flows radially inwardly through cavities in the vane(s), certain of which include inserts with apertures for impingement cooling the side walls of the vane. The cooling steam then enters a radially innermost first cavity in the inner band portion and reverses its flow direction for flow radially outwardly through an impingement plate into the associated second cavity for impingement cooling the nozzle wall of the inner band. The spent cooling medium returns through a cavity in the vane to an exhaust port of the nozzle segment radially outwardly of the outer band portion.

The cover provided each of the outer and inner band portions is preferably welded to the corresponding nozzle segment wall about the lateral margins of the nozzle segment, i.e., the leading and trailing edges and side edges of the segment. Consequently, a closed cooling system is provided through the nozzle segment in which the cooling medium, e.g., steam under pressure, flows through the band portions and the vanes. The steam, however, is contained within the chambers at different pressure levels as compared with the pressure of the gas path and the compressor discharge flow into portions of the fixed turbine casing surrounding the outer band portion. This pressure difference can cause high stress for the nozzle segment, especially at the joint region between the cover and the nozzle wall. The stress tends to balloon the cover and nozzle wall away from one another, bending the welded joint along the margins of the cover and nozzle wall.

These pressure-induced stress levels cause local high stress at the joint and the fillets interconnecting the nozzle wall and the vane. These high local stresses can reduce the low cycle fatigue life of the part. While a thicker wall or enhanced cooling scheme can be employed to cure some of these problems, each of those methods has serious drawbacks. For example, a thicker wall causes a high thermal gradient which has an adverse effect on the low cycle fatigue life of the part. Enhanced cooling is not always available and can be expensive in terms of turbine performance.

BRIEF SUMMARY OF THE INVENTION

In accordance with a preferred embodiment of the present invention, one or more structural elements, for example, pedestals, are interconnected between the cover and the nozzle wall to structurally support these nozzle parts and reduce the stress induced by the pressure differences in the closed loop cooling system of the turbine. By reducing those stresses, low cycle fatigue at the previously localized highly stressed parts is increased. To accomplish the foregoing, one or more structural pedestals are provided, interconnecting the cover and nozzle wall at locations within the chamber defined between the cover and the nozzle wall. The pedestals are spaced from the lateral margins of the nozzle segment and are located at one or more areas to preclude substantial ballooning of the nozzle segment wall and cover away from one another responsive to internal and external pressure differences. The pedestals are preferably in the form of pins which can have suitable cross-sections, such as circular, multi-sided or elongated. The pins are preferably cast with the nozzle wall and vane in a single crystal casting with the distal ends of the pedestals received through openings in the impingement plates and in openings in the covers. The distal ends are welded to the covers by a TIG welding or E-beam welding process externally of the segment. Alternatively, the pedestals can be cast on the cover and welded to the nozzle band or comprise discrete pedestals welded at both ends to the nozzle wall and cover. Preferably, the pedestals are located on each of the opposite sides of the opening of the vane through the nozzle wall, i.e., between the nozzle vane openings and the lateral margins of the segment.

In a preferred embodiment according to the present invention, there is provided for use in a gas turbine, a nozzle segment having outer and inner band portions and at least one vane extending between the band portions, at least one of the band portions including a nozzle wall defining in part a hot gas path through the turbine, a cover radially spaced from the nozzle wall, the cover and the nozzle wall being secured to one another about margins thereof and defining a chamber therebetween and at least one structural element interconnecting the cover and the nozzle wall inwardly of the margins to substantially prevent movement of the cover and the nozzle wall relative to one another in a generally radial direction.

In a further preferred embodiment according to the present invention, there is provided for use in a gas turbine, a nozzle segment having outer and inner band portions and at least one vane extending between the band portions, at least one of the band portions including a nozzle wall defining in part a hot gas path through the turbine, a cover radially spaced from the nozzle wall, the cover and the nozzle wall being secured to one another about margins thereof and defining a chamber therebetween, an impingement plate secured within the segment and disposed in the chamber to define with the cover a first cavity on one side thereof for receiving a cooling medium, the impingement plate on an opposite side thereof from the first cavity defining with the nozzle wall a second cavity, the impingement plate having a plurality of apertures therethrough for flowing the cooling medium from the first cavity into the second cavity for impingement cooling the nozzle wall, and at least one structural element interconnecting the cover and the nozzle wall inwardly of the margins to substantially prevent movement of the cover and the nozzle wall relative to one another in a generally radial direction, the impingement plate including a hole therethrough for receiving the structural element, the element and the hole lying laterally outwardly of a juncture between the vane and the nozzle wall.

DETAILED DESCRIPTION OF THE INVENTION

Figure 1:
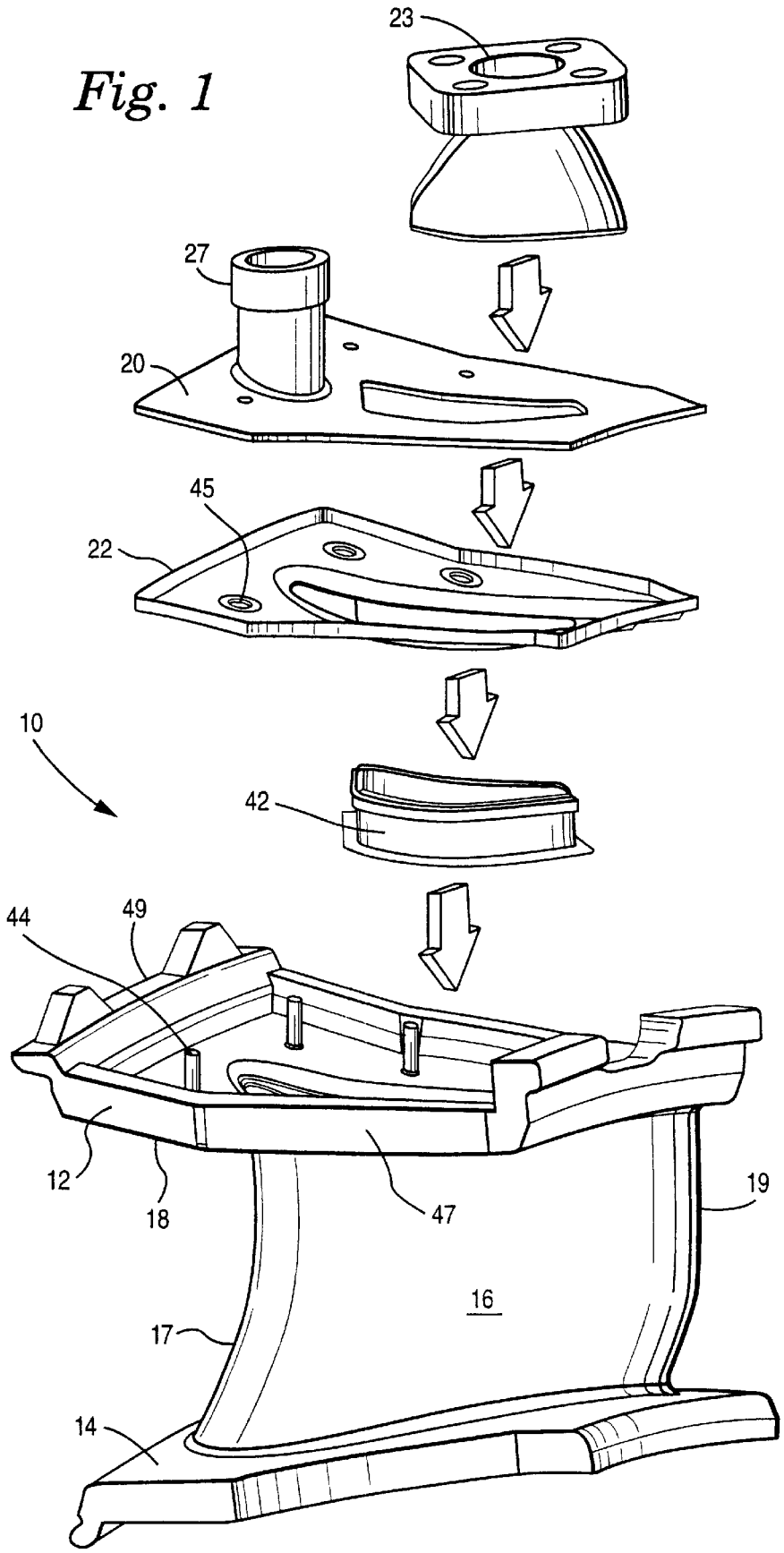
FIG. 1 is an exploded, perspective and schematic view of a nozzle segment constructed in accordance with a preferred embodiment of the present invention illustrating structural pedestals hereof.

Referring now to the drawings, there is illustrated a nozzle segment, generally designated 10, forming part of an annular array of segments disposed about a gas turbine axis. Each nozzle segment includes an outer band portion 12, an inner band portion 14 and one or more vanes 16 extending therebetween and having a leading edge 17 and a trailing edge 19. When the nozzle segments are arranged in the annular array, the outer and inner band portions 12 and 14 and vanes 16 define an annular hot gas path through the gas turbine and form part of a stage of the turbine as is conventional.

Figure 3:
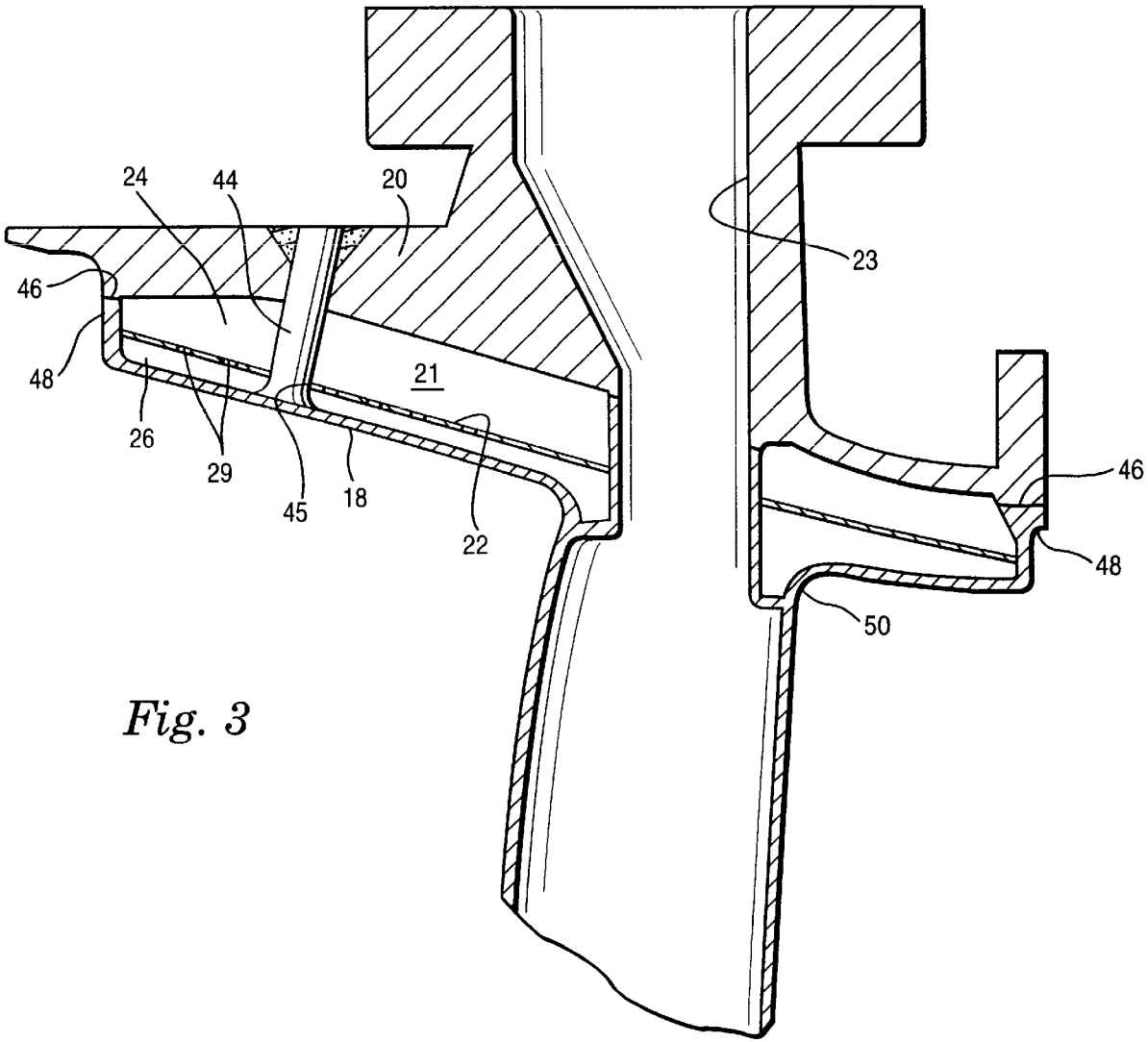
FIG. 3 is a cross-sectional view of FIG. 2 illustrating a pedestal interconnecting the cover and nozzle wall.

The outer and inner band portions and the vanes are cooled by flowing a cooling medium, for example, steam, through a chamber of the outer band portion 12 radially inwardly through cavities in the vanes, through a chamber in the inner band portion 14 and radially outwardly through the vanes for return of the cooling medium to an exit port 23 along the outer band portion 12. More particularly and by way of example as illustrated in FIGS. 1 and 3, the outer band portion 12 includes an outer nozzle wall 18, and an outer cover 20, which is disposed over and welded to the outer wall 18 to define a chamber 21 (FIG. 3) therebetween. An impingement plate 22 is disposed in the chamber 21. The impingement plate 22 defines with the nozzle segment cover 20 a first cavity 24 (FIG. 3) and, on an opposite side thereof, defines with the nozzle wall 18 a second cavity 26. A cooling medium inlet port 27 (FIG. 1) is provided through the outer cover 20 for supplying the cooling medium, e.g., steam, to the nozzle vane segment, the spent cooling steam being exhausted from the segment through exit port 23.

The cooling steam is supplied to the first cavity 24 via inlet 27 for passage through a plurality of apertures 29 in the impingement plate 22 for impingement cooling of the side wall 18. The vane or vanes 16 include cavities 30, 32, 34, 36, 38 and 40 extending through the vane(s) between the outer and inner band portions, the cavities being arranged sequentially from the leading edge to the trailing edge of the vane 16. The vane cavity 30 opens into the segment cavity 26 while the remaining vane cavities open into an endless vane extension 42 (FIG. 1) in communication with the exit port 16. Impingement cooling steam flows from the second segment cavity 26 into the first vane cavity 30 and into a vane cavity insert, not shown, for impingement cooling of the side walls of the vane. The cooling steam then flows into the chamber of the inner band portion 14 and particularly into the radially innermost cavity for flow through apertures of an impingement plate in. the inner band portion chamber for impingement cooling the side wall of the inner band portion. The spent cooling steam then flows through cavities 32, 34, 36, 38 and 40 in the vane and through apertures in inserts, not shown, in those cavities for impingement cooling the side walls of the vane(s) 16. The spent cooling steam empties into the exhaust port of the outer band portion 12. For a complete description of an embodiment of the foregoing-described cooling circuit, reference is made to U.S. Pat. No. 5,634,766, of common assignee, the disclosure of which is incorporated herein by reference.

As noted previously, there are substantial differences between the pressure within the chambers of the nozzle band portions, on the one hand, and the fluid pressure of the hot gas path and the air pressure within the fixed part of the turbine casing surrounding the nozzle segments, on the other hand. That pressure difference causes localized stress, particularly along the margins of the segments along which weld joints between the cover and the nozzle band portions are provided. Further, localized stresses occur at the fillets 42 (FIG. 3) between the nozzle wall and the vane(s). To provide enhanced structural support to the nozzle segments substantially minimizing or eliminating localized stresses due to these pressure differentials, one or more structural elements, for example, pedestals or pins 44, are provided within the chambers of the inner and outer band portions, for example, chamber 21 illustrated in FIG. 3, interconnecting the nozzle wall and the cover of the outer band portion 12. The structural elements 44 are preferably in the form of pins spaced from the surrounding or encompassing lateral walls of the band portions of the nozzle segments. The pins 44 are preferably integrally cast with the nozzle wall or with the cover with the opposite distal or free ends of the pins being welded to the opposing cover or nozzle wall, respectively. As illustrated in FIG. 3, the pin 44 may form an integral casting with the nozzle wall 18. Its opposite end is welded, for example, by a TIG weld or E-beam weld, to the cover 20. The reverse may also be provided, that is, the pins 44 may be integrally cast with the cover, e.g., cover 20, and its distal end welded to the nozzle wall 18. A further alternative is to provide discrete pins and weld the pins at the opposite ends to the nozzle wall and cover.

Figure 2:
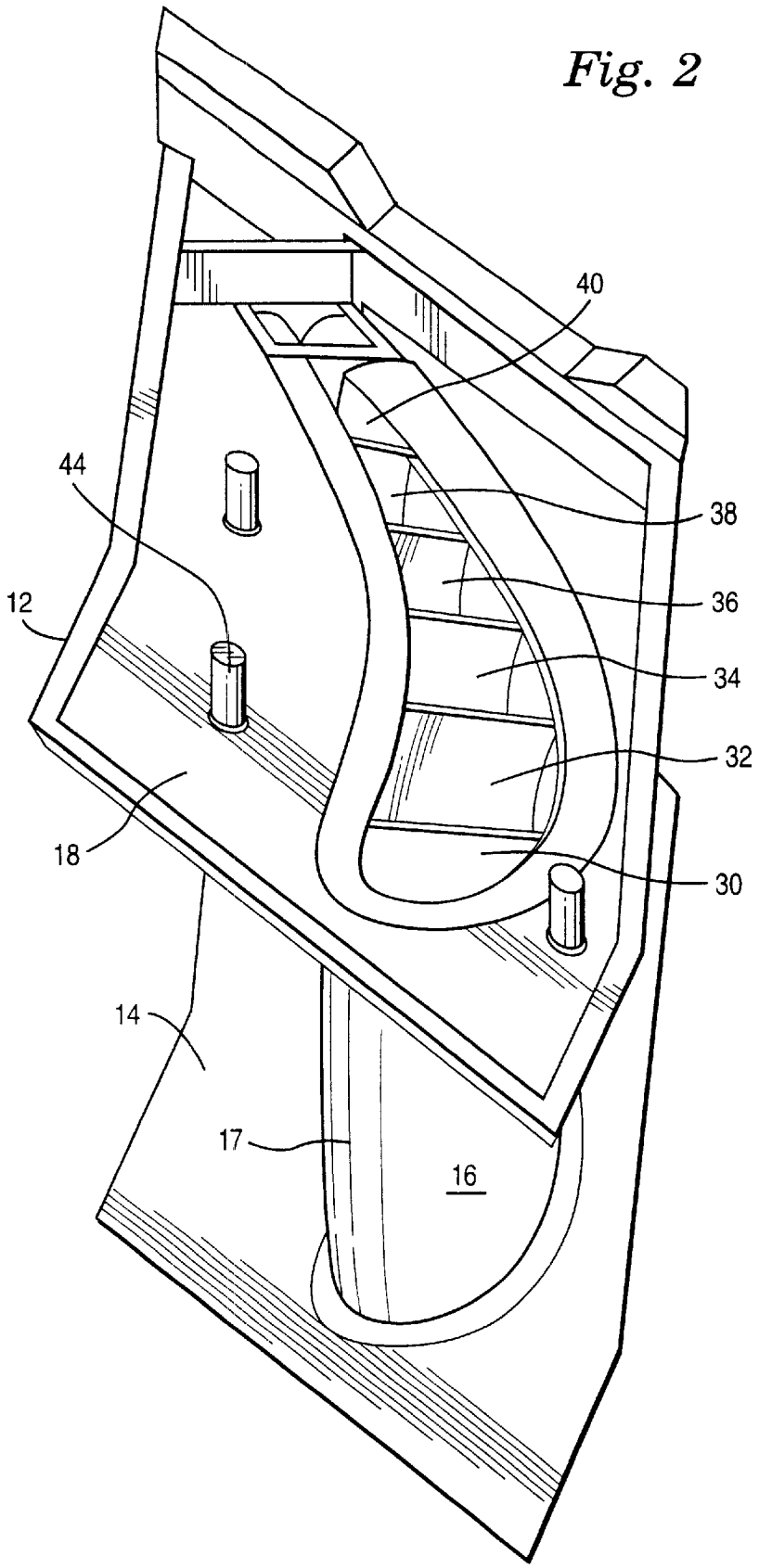
FIG. 2 is a perspective view illustrating primarily the outer band portion and the pedestals projecting therefrom with the cover and impingement plate removed.

Referring particularly to FIG. 2, the elements 44 are spaced laterally inwardly from the side and end walls 47 and 49, respectively, of the lateral margins 48 of the nozzle segment band portion and laterally outwardly of the openings of the vane cavities through the nozzle wall. The elements 44 are thus spaced laterally outwardly of the juncture of the vane and nozzle wall. Preferably, a pair of elements 44 are located adjacent opposite sides of the first cavity 30 of the vane, i.e., adjacent the leading edge of the vane. A third element 44 is preferably located intermediate the length of the vane and on the concave side of the vane to interconnect the cover and nozzle wall in that area. It will be appreciated that holes 45 are provided through the impingement plate 22 for receiving the elements 44.

With the structural elements 44 interconnecting the cover and the nozzle wall, any tendency of the pressure differential to cause the cover and nozzle wall to balloon away from one another is minimized or eliminated. As a consequence, the weld joints 46 along the lateral margins 48 of the nozzle segment joining the covers and nozzle walls to one another have reduced localized stress and minimum bending moments. Additionally, the fillet areas 50 between the nozzle wall and vane(s) likewise have reduced localized stresses. Consequently, by locating the structural elements to preclude relative displacement of the cover and nozzle wall in response to these pressure differentials, low cycle fatigue life of the part is significantly increased.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For use in a gas turbine, a nozzle segment having outer and inner band portions and at least one vane extending between said band portions, at least one of said band portions including a nozzle wall defining in part a hot gas path through the turbine, a cover radially spaced from said nozzle wall, said cover and said nozzle wall being secured to one another about margins thereof and defining a chamber therebetween, at least one structural element interconnecting said cover and said nozzle wall inwardly of said margins to substantially prevent movement of said cover and said nozzle wall relative to one another in a generally radial direction, and an impingement plate secured within said segment and disposed in said chamber to define with said cover a first cavity on one side thereof for receiving a cooling medium, said impingement plate on an opposite side thereof from said first cavity defining with said nozzle wall a second cavity, said impingement plate having a plurality of apertures therethrough for flowing the cooling medium from said first cavity into said second cavity for impingement cooling said nozzle wall, said impingement plate including a hole therethrough for receiving said structural element.

2. A nozzle segment according to claim 1 wherein said vane has a leading edge and a trailing edge and vane cavities opening through said nozzle wall, said element being located between a margin of said segment and said vane cavities opening through said nozzle wall and adjacent said leading edge of said vane.

3. A nozzle segment according to claim 1 including a second structural element interconnecting said cover and said nozzle wall inwardly of a side wall of said segment.

4. A nozzle segment according to claim 3 wherein said second structural element interconnects said cover and said nozzle wall at a location between another side wall of said segment and said vane cavity openings through said nozzle wall.

5. A nozzle segment according to claim 3 wherein said second structural element interconnects said cover and said nozzle wall at a location between another side wall of said segment and said vane cavity openings through said nozzle wall and adjacent a leading edge of said vane.

6. A nozzle segment according to claim 3 wherein said second structural element interconnects said cover and said nozzle wall at a location between another side wall of said segment and said vane cavity openings through said nozzle wall and adjacent an intermediate portion of said vane cavity openings.

7. A nozzle segment according to claim 1 wherein said vane, said nozzle wall and said structural element form an integral part of a casting for said nozzle segment.

8. A nozzle segment according to claim 1 including a vane extension extending between said nozzle wall and said cover, said element being located between a margin of said segment and said vane extension.

9. For use in a gas turbine, a nozzle segment having outer and inner band portions and at least one vane extending between said band portions, at least one of said band portions including a nozzle wall defining in part a hot gas path through the turbine, a cover radially spaced from said nozzle wall, said cover and said nozzle wall being secured to one another about margins thereof and defining a chamber therebetween, at least one structural element interconnecting said cover and said nozzle wall inwardly of said margins to substantially prevent movement of said cover and said nozzle wall relative to one another in a generally radial direction, and wherein said structural element comprises a pin extending between said nozzle wall and said cover.

10. For use in a gas turbine, a nozzle segment having outer and inner band portions and at least one vane extending between said band portions, at least one of said band portions including a nozzle wall defining in part a hot gas path through the turbine, a cover radially spaced from said nozzle wall, said cover and said nozzle wall being secured to one another about margins thereof and defining a chamber therebetween, at least one structural element interconnecting said cover and said nozzle wall inwardly of said margins to substantially prevent movement of said cover and said nozzle wall relative to one another in a generally radial direction, and wherein said structural element is welded to said cover.

11. For use in a gas turbine, a nozzle segment having outer and inner band portions and at least one vane extending between said band portions, at least one of said band portions including a nozzle wall defining in part a hot gas path through the turbine, a cover radially spaced from said nozzle wall, said cover and said nozzle wall being secured to one another about margins thereof and defining a chamber therebetween, at least one structural element interconnecting said cover and said nozzle wall inwardly of said margins to substantially prevent movement of said cover and said nozzle wall relative to one another in a generally radial direction, and said structural element is welded at opposite ends to said nozzle wall and said cover.

12. For use in a gas turbine, a nozzle segment having outer and inner band portions and at least one vane extending between said band portions, at least one of said band portions including a nozzle wall defining in part a hot gas path through the turbine, a cover radially spaced from said nozzle wall, said cover and said nozzle wall being secured to one another about margins thereof and defining a chamber therebetween, an impingement plate secured within said segment and disposed in said chamber to define with said cover a first cavity on one side thereof for receiving a cooling medium, said impingement plate on an opposite side thereof from said first cavity defining with said nozzle wall a second cavity, said impingement plate having a plurality of apertures therethrough for flowing the cooling medium from said first cavity into said second cavity for impingement cooling said nozzle wall, and at least one structural element interconnecting said cover and said nozzle wall inwardly of said margins to substantially prevent movement of said cover and said nozzle wall relative to one another in a generally radial direction, said impingement plate including a hole therethrough for receiving said structural element, said element and said hole lying laterally outwardly of a juncture between the vane and the nozzle wall.

13. A nozzle segment according to claim 12 including a second structural element interconnecting said cover and said nozzle wall inwardly of a side wall of said segment and laterally outwardly of said juncture.

14. A nozzle segment according to claim 13 wherein said structural element comprise pins extending between said nozzle wall and said cover and through said impingement plate.

15. A nozzle segment according to claim 13 wherein said vane, said nozzle wall and said structural elements form an integral part of a casting for said nozzle segment.

16. A nozzle segment according to claim 13 wherein said structural elements are welded to said cover.

17. A nozzle segment according to claim 13 wherein said structural elements are welded at opposite ends to said nozzle wall and said cover.

18. A nozzle segment according to claim 13 including a vane extension extending between said nozzle wall and said cover, said elements being located between a margin of said segment and said vane extension.

* * * * *